US006293001B1

(12) United States Patent
Uriu et al.

(10) Patent No.: US 6,293,001 B1
(45) **Date of Patent: *Sep. 25, 2001**

(54) METHOD FOR PRODUCING AN INDUCTOR

(75) Inventors: Eiichi Uriu, Neyagawa; Osamu Makino, Hirakata; Hironobu Chiba, Itami; Chisa Yokota, Osaka, all of (JP)

(73) Assignee: Matsushita Electric Industrial Co., Ltd., Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/257,797

(22) Filed: Feb. 25, 1999

Related U.S. Application Data

(62) Division of application No. 08/526,713, filed on Sep. 11, 1995, now abandoned.

(30) Foreign Application Priority Data

Sep. 12, 1994 (JP) ..... 6-217150

(51) Int. Cl.[7] ..... H01F 41/02
(52) U.S. Cl. ..... 29/608; 29/602.1; 336/200
(58) Field of Search ..... 29/602.1, 608; 336/200

(56) References Cited

U.S. PATENT DOCUMENTS

| | | | |
|---|---|---|---|
| 3,247,573 | 4/1966 | Noack | 29/155.5 |
| 3,414,487 | 12/1968 | Helms et al. | 204/11 |
| 3,765,082 | 10/1973 | Zyetz | 29/602 |
| 3,798,059 | 3/1974 | Astle et al. | 117/212 |
| 3,812,442 | 5/1974 | Muckelroy | 336/83 |
| 3,833,872 | 9/1974 | Marcus et al. | 336/83 |
| 3,971,126 | 7/1976 | Buhrer | 29/604 |
| 4,586,976 | 5/1986 | Takano et al. | 156/233 |
| 4,604,160 | 8/1986 | Murakami et al. | 29/630 |
| 4,689,594 | 8/1987 | Kawabata et al. | 336/200 |
| 4,753,694 | 6/1988 | Herron et al. | 156/89 |
| 4,959,631 | 9/1990 | Hasegawa et al. | 336/83 |
| 5,063,658 | 11/1991 | Wild | 204/846 |
| 5,233,157 | 8/1993 | Schreiber et al. | 156/121.68 |
| 5,302,932 | 4/1994 | Person et al. | 336/200 |
| 5,312,674 | 5/1994 | Haertling et al. | 428/210 |
| 5,354,205 | 10/1994 | Feigenbaum et al. | 439/67 |
| 5,358,604 | 10/1994 | Lin et al. | 156/664 |
| 5,470,412 | 11/1995 | Fukuta et al. | 219/89 |
| 5,480,503 | 1/1996 | Casey et al. | 156/89 |

FOREIGN PATENT DOCUMENTS

| | | | |
|---|---|---|---|
| 633477 | 6/1963 | (BE) . | |
| 1279797 | 10/1968 | (DE) | H05K/2/31 |
| 0152634 | 8/1985 | (EP) | H05K/3/20 |

(List continued on next page.)

OTHER PUBLICATIONS

Search Report for European Patent Application 95114233.0 mailed Jan. 26, 1996.

Bulletta, IBM Technical Disclaimer, vol. 36, No. 1 (Jan. 1993) pp. 102–103. (Not Enclosed).

News ans der technik No. 2 (Jul. 10, 1990). (Not Enclosed).

Search Report for European Patent Application 95115632.2 mailed Jan. 24, 1996. (Not Enclosed).

*Primary Examiner*—Carl E. Hall
(74) *Attorney, Agent, or Firm*—Renner, Otto, Boiselle & Sklar, LLP

(57) ABSTRACT

A lamination ceramic chip inductor includes at least one pair of insulation layers; and at least one conductive pattern which is interposed between the at least one pair of insulation layers and forming a conductive coil. At least one conductive pattern includes a conductive pattern formed as a result of electroforming.

7 Claims, 12 Drawing Sheets

FOREIGN PATENT DOCUMENTS

| | | | |
|---|---|---|---|
| 0185998 | 7/1986 | (EP) | H05K/3/44 |
| 0310396 | 4/1989 | (EP) | H01F/5/00 |
| 0413348 | 2/1991 | (EP) | H01F/17/00 |
| 0533198 | 3/1993 | (EP) | H05K/1/03 |
| 58-012315 | 1/1983 | (JP) | H01F/41/04 |
| 59-152605 | 8/1984 | (JP) | H01F/15/00 |
| 59-145009 | 9/1984 | (JP) | H01F/15/00 |
| 60-167306 | 8/1985 | (JP) | H01F/5/00 |
| 60-176208 | 9/1985 | (JP) | H01F/17/02 |
| 61-140115 | 6/1986 | (JP) | H01F/17/04 |
| 61-295617 | 12/1986 | (JP) | H01F/41/04 |
| 63-284886 | 11/1988 | (JP) | H05K/3/20 |
| 642394 | 1/1989 | (JP) | H05K/3/20 |
| 6442809 | 2/1989 | (JP) | H01G/4/12 |
| 2228093 | 9/1990 | (JP) | H05K/3/20 |
| 323603 | 1/1991 | (JP) | H01F/17/00 |
| 3219605 | 9/1991 | (JP) | H01F/17/00 |
| 465807 | 3/1992 | (JP) | H01F/17/00 |
| 493006 | 3/1992 | (JP) | H01F/17/06 |
| 4314876 | 11/1992 | (JP) | H01G/4/12 |
| 5258973 | 8/1993 | (JP) | H01F/27/28 |
| 5234792 | 9/1993 | (JP) | H01F/41/04 |
| 5335149 | 12/1993 | (JP) | H01F/17/00 |
| 6089811 | 3/1994 | (JP) | H01F/17/00 |
| 696953 | 8/1994 | (JP) | H01F/17/00 |
| 757961 | 3/1995 | (JP) | H01G/4/12 |
| 775909 | 8/1995 | (JP) . | |
| WO8900373 | 1/1989 | (WO) | H05K/3/20 |

METHOD FOR PRODUCING AN INDUCTOR

This is a division of application Ser. No. 08/526,713, filed Sep. 11, 1995, now abandoned.

BACKGROUND OF THE INVENTION

1. Field of the Invention

The present invention relates to a ceramic chip inductor and a method for producing the same, and in particular, a lamination ceramic chip inductor used in a high density circuit and a method for producing the same.

2. Description of the Related Art

Recently, lamination ceramic chip inductors are widely used in high density mounting circuits, which have been demanded by size reduction of digital devices such as devices for reducing noise.

As an example of the conventional art, a method for producing a conventional lamination ceramic chip inductor described in Japanese Laid-Open Utility Model Publication No. 59-145009 will be described.

On each of a plurality of magnetic greensheets, a conductive pattern formed of a conductive paste of less than one turn is printed. The plurality of magnetic greensheets are laminated and attached by pressure to form a lamination body. The conductive lines on the magnetic greensheets are electrically connected with each other sequentially via a through-hole formed in the magnetic sheets to form a conductive coil. The lamination body is sintered entirely to produce a lamination ceramic chip inductor.

Such a lamination ceramic chip inductor requires a larger number of turns of the conductive coil and thus a larger number of greensheets in order to have a higher impedance or inductance.

An increase in the number of greensheets requires a larger number of lamination steps and thus raises production cost. In addition, such an increase raises the number of the points of connection between the conductive patterns on the greensheets, thus reducing the reliability of connection.

A solution to these problems is proposed in Japanese Laid-Open Patent Publication No. 4-93006. A lamination ceramic chip inductor disclosed in this publication is produced in the following manner.

On each of a plurality of magnetic sheets, a conductive pattern of more than one turn is formed using a thick film printing technology, and the plurality of magnetic sheets are laminated. The conductive patterns on the magnetic sheets are electrically connected to each other sequentially via a through-hole formed in advance in the magnetic sheets. A lamination ceramic chip inductor produced in this manner has a relatively large impedance even if the number of the magnetic sheets is relatively small.

Such a lamination ceramic chip inductor produced using a thick film technology has the following two disadvantages.

(1) In the production of a lamination ceramic chip inductor having an outer profile as small as, for example, 2.0 mm×1.25 mm or 1.6 mm×0.8 mm using a thick film printing technology, the number of turns of each conductive pattern is approximately 1.5 at the maximum for practical use with the production yield and the like considered. In order to produce an inductor having a larger impedance, the number of the magnetic sheets needs to be increased.

(2) In order to increase the number of turns in one magnetic sheet, the width of each conductive pattern needs to be reduced. Since a reduced width of the conductive pattern increases the resistance thereof, the thickness of the conductive pattern needs to be increased. However, in order to maintain the printing resolution, the thickness of the conductive pattern needs to be reduced as the width thereof is decreased. For example, when the width is 75 μm, an appropriate thickness of the conductive pattern when being dry is approximately 15 μm at the maximum.

From the above description, it is appreciated that increasing the number of turns of each conductive pattern is not practical although effective to some extent in reducing the number of the magnetic sheets.

In order to reduce the resistance of the conductive pattern, Japanese Laid-Open Patent Publication No. 3-219605 discloses a method by which a greensheet is grooved, and the groove is filled with a conductive paste to increase the thickness of the conductive pattern. However, it is difficult to mass-produce a grooved greensheet in a complicated pattern.

Japanese Laid-Open Patent Publication No. 60-176208 also discloses a method for reducing the resistance of the conductive pattern of a lamination body having magnetic layers and conductive patterns each of approximately a half turn alternately laminated. In this method, the conductive patterns to be formed into a conductive coil are formed by punching a metal foil. However, it is difficult to punch out a pattern with sufficient precision to fit into a microscopic planar area as demanded by the recent size reduction of various devices. In fact, it is impossible to obtain a complicated coil pattern having one or more turns by punching. Further, it is difficult to arrange a plurality of metal foils obtained by punching on a magnetic sheet at a constant pitch with high precision. Moreover, when the metal foils adjacent to each other are connected with a magnetic sheet interposed therebetween, defective connection can undesirably occur unless the connection technology is sufficiently high.

A solution to the above-described problems from a different point view is disclosed in Japanese Laid-Open Patent Publication No. 64-42809 and Japanese Laid-Open Patent Publication 4-314876. In these publications, a metal thin layer formed on a film is transferred onto a ceramic greensheet to produce a lamination ceramic capacitor.

In detail, on a releasable metal thin layer formed on a film by evaporation, a desired metal layer is formed by wet plating. When necessary, an extra portion of the metal layer is removed by etching. The resultant pattern is transferred onto a ceramic greensheet.

Such a transfer method can be applied to transfer a conductive coil onto a magnetic greensheet in the following manner to produce a lamination ceramic chip inductor.

A relatively thin metal layer (having a thickness of, for example, 10 μm or less) formed on a film is etched using a photoresist to form a fine conductive coil pattern (having a width of, for example, 40 μm and a space between lines of, for example, 40 μm). The resultant coil is then transferred onto a magnetic greensheet. In this manner, a lamination ceramic chip inductor for having a large impedance can be produced.

By the above-described transfer method, it is difficult to produce a relatively thick conductive coil having a pattern to be transferred (having a thickness of, for example, 10 μm or more) for the following reason.

By the transfer method using wet plating, the metal layer which is once formed on the entire surface of a film is patterned by removing an unnecessary portion. Accordingly, production of a complicated coil pattern becomes more difficult as the thickness of the metal film increases.

Further, since the desired pattern is obtained under the photoresist, the photoresist needs to be removed before the transfer. When the photoresist is removed, the conductive coil pattern may also be undesirably removed. Such a phenomenon becomes easier to occur as the thickness of the metal layer increases. The reason is that: as the thickness of the metal layer increases, etching takes a longer period of time and thus the thin metal film is exposed to the etchant to a higher degree.

For the above-described reasons, the transfer method cannot provide a lamination ceramic chip inductor having a low resistance.

SUMMARY OF THE INVENTION

In one aspect of the present invention, a lamination ceramic chip inductor includes at least one pair of insulation layers; and at least one conductive pattern interposed between the at least one pair of insulation layers and forming a conductive coil. At least one conductive pattern includes a conductive pattern formed as a result of electroforming.

In one embodiment of the invention, a plurality of conductive patterns are included, and at least two of the conductive patterns are electrically connected to each other by a thick film conductor formed by printing.

In one embodiment of the invention, the at least one electroformed conductive pattern is wave-shaped.

In one embodiment of the invention, the plurality of conductive patterns include an electroformed conductive pattern having a shape of a straight line.

In one embodiment of the invention, at least one pair of insulation layers are magnetic.

In one embodiment of the invention, the insulation layers are formed of a material containing one of a non-shrinkage powder which does not shrink from sintering and a low-ratio shrinkage powder which shrinks slightly from sintering.

In one embodiment of the invention, the insulation layers are formed of a magnetic material containing an organolead compound as an additive for restricting deterioration of a magnetic characteristic of the insulation layers.

In one embodiment of the invention, the conductive pattern formed as a result of electroforming is formed of a silver plating liquid containing no cyanide.

In another aspect of the present invention, a method for producing a lamination ceramic chip inductor includes the steps of forming a conductive pattern on a conductive base plate by electroforming; transferring the electroformed conductive pattern onto a first insulation layer; and forming a second insulation layer on a surface of the first insulation layer, the surface having the electroformed conductive pattern.

In one embodiment of the invention, the method further includes the steps of forming a plurality of first insulation layers each having an electroformed conductive pattern transferred thereon; and laminating the plurality of first insulation layers while electrically connecting the electroformed conductive patterns to each other sequentially.

In one embodiment of the invention, the method further includes the step of interposing a third insulation layer having a through-hole therein between the first and the second insulation layers.

In one embodiment of the invention, the method further includes the step of interposing a third insulation layer having a through-hole filled with a thick film conductor printed therein between the plurality of first insulation layers.

In one embodiment of the invention, the method further includes the step of interposing a third insulation layer which has a through-hole having a conductive bump formed as a result of electroforming therein between the plurality of first insulation layers.

In one embodiment of the invention, wherein the step of transferring includes the steps of forming the first insulation layer on a surface of the conductive base plate, the surface having the electroformed conductive pattern; adhering a thermally releasable sheet on the first insulation layer; peeling off the first insulation layer having the electroformed conductive pattern and the thermally releasable sheet from the conductive base plate; and peeling off the thermally releasable sheet by heating.

In one embodiment of the invention, the step of transferring includes the steps of adhering a thermally releasable foam sheet on a surface of the conducive base plate by heating and foaming, the surface having the electroformed conductive pattern; peeling off the thermally releasable foam sheet and the electroformed conductive pattern from the conducive base plate; forming first insulation layer on a surface of the thermally releasable foam sheet, the surface having the electroformed conductive pattern; and peeling off the thermally releasable foam sheet by heating.

In one embodiment of the invention, the step of forming the electroformed conductive pattern includes the steps of coating the conductive base plate with a photoresist film so as to expose the conductive base plate in a desired pattern; forming a conductive film on the conductive base plate covering the photoresist film; and removing the photoresist film from the conductive base plate.

In one embodiment of the invention, the conductive base plate is treated to have conductivity and releasability.

In one embodiment of the invention, the conductive base plate is formed of stainless steel.

In one embodiment of the invention, the electroformed conductive pattern is formed using an Ag electroplating bath having a pH value of 8.5 or less.

In one embodiment of the invention, the conductive base plate has a surface roughness of 0.05 to 1 $\mu$m.

In one embodiment of the invention, the first, second and third insulation layers are magnetic.

A lamination ceramic chip inductor according to the present invention includes a conductive pattern formed by electroforming using a photoresist. Accordingly, the thickness of the conductive pattern can be sufficient to obtain a sufficiently low resistance, and the width of the conductive pattern can be adjusted with high precision.

In contrast to a thick film conductive pattern formed by printing or the like, the conductive pattern formed according to the present invention is shrunk in the thickness direction only slightly by sintering. Thus, the magnetic sheet and the conductive patterns are scarcely delaminated from each other.

Thus, the invention described herein makes possible the advantages of providing a lamination ceramic chip inductor including a relatively small number of sheets, a sufficiently high impedance, and a low resistance of the conductive coil; and a method for producing the same.

These and other advantages of the present invention will become apparent to those skilled in the art upon reading and understanding the following detailed description with reference to the accompanying figures.

DESCRIPTION OF THE PREFERRED EMBODIMENTS

Hereinafter, the present invention will be described by way of illustrative examples with reference to the accompanying drawings.

EXAMPLE 1

Figure 1:
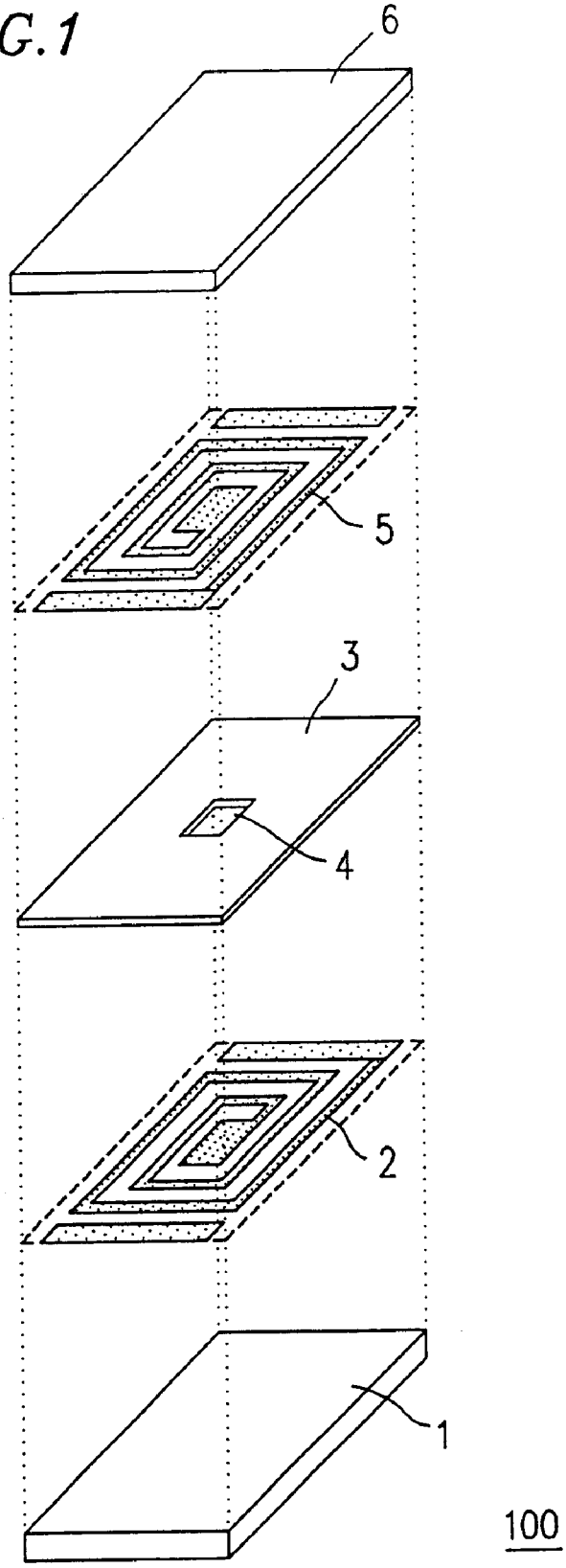
FIG. 1 is an exploded isometric view of a lamination ceramic chip inductor in a first example according to the present invention.

A lamination ceramic chip inductor 100 in a first example according to the present invention will be described with reference to FIGS. 1 through 6. FIG. 1 is an exploded isometric view of the lamination ceramic chip inductor (hereinafter, referred to simply as an "inductor") 100.

In all the accompanying figures, only one lamination body to be formed into one inductor is illustrated for simplicity. In actual production, a plurality of lamination bodies are formed on one plate and separated after the lamination bodies are completed.

The inductor 100 shown in FIG. 1 includes a plurality of magnetic sheets 1, 3 and 6, and a plurality of coil-shaped plated conductive pattern (hereinafter, referred to simply as "conductive patterns") 2 and 5.

The conductive patterns 2 and 5 are each formed by electroforming; namely, a resist film is formed on a base plate to expose a desired pattern and immersing the base plate in a plating bath. The magnetic sheets 1 and 6 respectively have the conductive patterns 2 and 5 transferred thereon. The conductive patterns 2 and 5 are connected to each other via a through-hole 4 formed in the magnetic sheet 3.

A method for producing the inductor 100 will be described.

[Formation of the conductive patterns]

Figure 2:
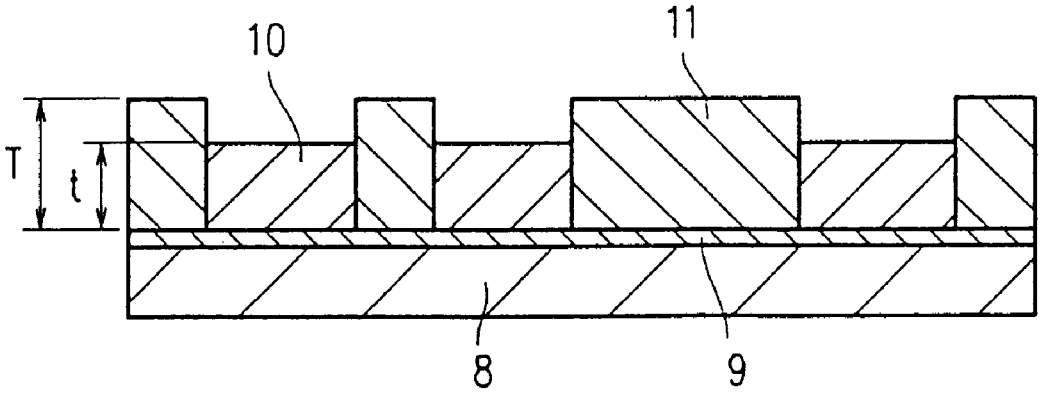
FIGS. 2 through 5 are cross sectional views illustrating a method for producing the lamination ceramic chip inductor shown in FIG. 1.

First, how to form the conductive patterns 2 and 5 will be described with reference to FIG. 2.

A stainless steel base plate 8 is entirely treated by strike plating (plating at a high speed) with Ag to form a conductive release layer 9 having a thickness of approximately 0.1 $\mu$m or less. The strike plating is performed by immersing the base plate 8 in an alkaline AgCN bath, which is generally used. An exemplary composition of an alkaline AgCN bath is shown in Table 1.

TABLE 1

| | |
|---|---|
| AgCN | 3.8 to 4.6 g/l |
| KCN | 75 to 90 g/l |
| Liquid temperature | 20 to 30° C. |
| Current density | 1.6 to 3.0 A/dm$^2$ |

When the bath shown in Table 1 is used, a release layer having a thickness of approximately 0.1 $\mu$m is formed after approximately 5 to 20 seconds.

One probable reason that the release layer 9 has releasability is: since an Ag layer is formed by high-speed plating (strike plating) on the stainless steel base plate 8 having a low level of adherence with Ag, the resultant Ag layer (the release layer 9) becomes highly strained and thus cannot be sufficiently adhered with the base plate 8.

In order to obtain an optimum level of releasability between the release layer 9 and the base plate 8, the surface of the base plate 8 is preferably roughened to have a surface roughness (Ra) of approximately 0.05 $\mu$m to approximately 1 $\mu$m. The surface roughness (Ra) is measured by a surface texture analysis system using, for example, Dektak 3030ST (produced by Sloan Technology Corp). The surface is roughened by acid treatment, blasting or the like.

In the case where the surface roughness (Ra) is less than approximately 0.05 $\mu$m, the adherence between the release layer 9 and the base plate 8 is insufficient, and thus the release layer 9 is possibly delaminated during the later process. In the case where the surface roughness (Ra) is more than approximately 1 $\mu$m, the adherence between the release layer 9 and the base plate 8 is excessive. Thus, the release layer 9 cannot be satisfactorily transferred onto the magnetic sheet, or the resolution of a plating resist pattern 11 formed in the following step (described below) is lowered.

Appropriate roughening the surface of the base plate 8 has such side effects that the adherence of the plating resist pattern 11 on the release layer 9 is improved and that the release layer 9 is prevented from being released from the base plate 8 during removal of the plating resist pattern 11.

The release layer 9 can also be formed by silver mirror reaction.

The base plate 8 can be formed of an electrically conductive material other than stainless steel and processed to have releasability. Exemplary materials which can be used for the base plate 8 and the respective methods for providing the base plate 8 with releasability are shown in Table 2.

TABLE 2

| Usable metal | Method for providing releasability |
|---|---|
| iron-nickel-type metal | Anodizing with NaOH (10%) to form an excessively thin oxide film. |
| Copper-nickel-type metal | Immersing in potassium bichromate to form a chromate film. |

TABLE 2-continued

| Usable metal | Method for providing releasability |
|---|---|
| Aluminum | Immersing in a zinc substitution liquid to form a zincate. |
| Copper, brass | Immersing a 0.5% solution of selenium dioxide |

Instead of metal, the base plate 8 can be formed of a printed circuit board having a copper foil laminated thereon, or a polyethyleneterephthalate (hereinafter, referred to as "PET") film or the like provided with conductivity. The same effects are obtained as by metal, but a metal plate is more efficient since it is not necessary to provide a metal plate with conductivity.

Especially, stainless steel is chemically stable and has satisfactory releasability due to a chrome oxide film existent on a surface thereof. Thus, stainless steel is the easiest to use from among the usable materials.

After the release layer 9 is formed, a photoresist film is formed on the release layer 9 and pre-dried. Then, a photomask having a width of approximately 70 $\mu$m and approximately 2.5 turns is formed on each of unit areas of the photoresist film. Each unit area has a size of 2.0 mm×1.25 mm. The photomask has such a pattern as to form a desirable conductive pattern depending on the type of photoresist (i.e., positive-type or negative-type). The photoresist film having a photomask thereon is exposed to light and developed to form the plating resist pattern 11 having a thickness T=55 $\mu$m.

As the photoresist, various kinds (liquid, paste, dry film) or the like can be used. A dry film has a uniform thickness and thus controls the thickness of the conductive patterns with relatively high precision, but is preferably used for forming a conductive pattern having a width of approximately 50 $\mu$m or more with the sensitivity thereof being considered. With a liquid photoresist, a plating resist pattern having a width as small as several microns can be obtained. With a paste photoresist, which is the photoresist most generally used, a plating resist pattern having a width of approximately 40 $\mu$m and a thickness of approximately 30 to 40 $\mu$m can be obtained. In detail, for example, a plating resist pattern having approximately five turns can be easily formed on a unit area of approximately 2.0 mm×1.25 mm, and a plating resist pattern having approximately three turns can be easily formed on a unit area of approximately 1.6 mm×0.8 mm. The photoresist can be formed by printing, spin-coating, roll-coating, dipping, laminating or the like, depending on the kind of the photoresist.

The exposure is performed by an exposure device emitting collimated ultraviolet light rays, and conditions such as exposure time and the light intensity are determined in accordance with the photoresist used.

Development is performed using a developer suitable for the photoresist used. When necessary, exposure to ultraviolet or post-curing is performed after the development to improve the resistance against chemicals.

After the plating resist pattern 11 is formed, the lamination body is immersed in the Ag electroplating bath to form an Ag conductive pattern 10 having a necessary thickness t, which will be transferred on the magnetic sheet. In this example, the Ag conductive pattern 10 has a thickness t of approximately 50 $\mu$m. An alkaline Ag bath, which is the type generally used as the Ag electroplating bath, cannot be used because the Ag bath removes the plating resist pattern 11. Accordingly, a weak alkaline, neutral, or acid Ag plating bath is required as the Ag electroplating bath. An exemplary composition of a weak alkaline or neutral Ag plating bath is shown in Table 3.

TABLE 3

| | |
|---|---|
| $KAg(CN)_2$ | 30 g/l |
| KSCN | 330 g/l |
| Potassium citrate | 5 g/l |
| pH | 7.0 to 7.5 |
| Liquid temperature | Room temperature |
| Current density | 2.0 A/dm$^2$ or less |

The pH value of the Ag plating bath is adjusted by ammonia and a citrate. As a result of various experiments, it has been found that plating resist pattern 11 formed of most kinds of photoresist is removed by a plating bath having a pH value of more than 8.5. Accordingly, the pH value of the plating bath is preferably set to be 8.5 or less.

An exemplary composition of an acid Ag plating bath is shown in Table 4.

TABLE 4

| | |
|---|---|
| AgCl | 12 g/l |
| $Na_2S_2O_3$ | 36 g/l |
| $NaHSO_3$ | 4.5 g/l |
| $NaSO_4$ | 11 g/l |
| pH | 5.0 to 6.0 |
| Liquid temperature | 20 to 30° C. |
| Current density | 1.5 A/dm$^2$ or less |

The plating bath shown in Table 4 does not remove the plating resist pattern 11 because of being acid. When an acid Ag plating bath containing a surfactant (methylimidazolethiol, furfural, turkey-red oil, or the like) is used, the brilliance and the smoothness of the surface of the Ag conductive pattern 10 are improved.

In this example, the weak alkaline or neutral Ag plating bath shown in Table 3 is used. The pH value is 7.3, and the current density for plating is approximately 1 A/dm$^2$. The current density is set to be such a value because an excessively high current density required for accelerating a plating speed causes strain of the Ag conductive pattern 10, thus possibly removing the Ag conductive pattern 10 before being transferred.

The Ag conductive pattern 10 having a thickness of approximately 50 $\mu$m is obtained after immersing the base plate 8 in the plating bath for approximately 260 minutes.

Figure 3:
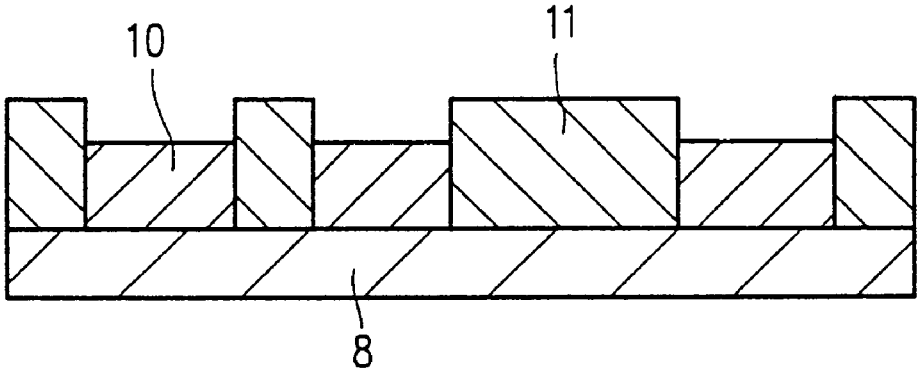

In this example, the release layer 9 is formed by strike-plating the base plate 8 in an alkali Ag bath. Alternatively, the base plate 8 can be immersed in a weak alkaline, neutral, or acid bath. In this case, a sufficiently high current density is used for the first several minutes in order to strain the Ag conductive pattern 10 sufficiently to provide an area of the Ag conductive pattern 10 in the vicinity of the surface of the stainless steel base plate 8 with releasability. Accordingly, it is not necessary to form the release layer 9. FIG. 3 shows a cross section of the lamination body formed in this manner.

Figure 4:
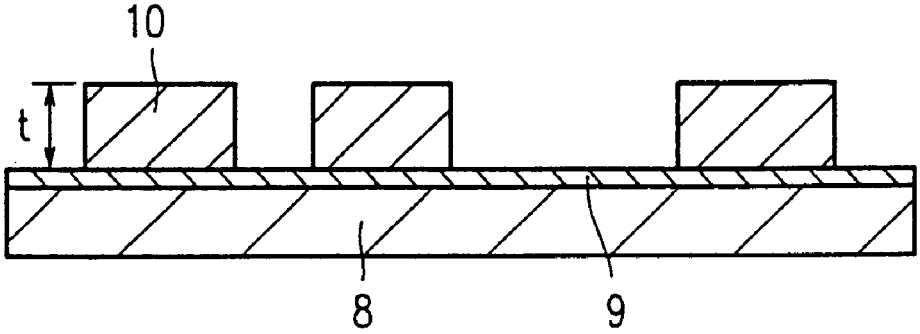

After the Ag conductive pattern 10 is formed, the plating resist pattern 11 is removed as is shown in FIG. 4, using a removing liquid suitable for the photoresist used. Usually, the removal is performed by immersing the lamination body in an approximately 5% solution of NaOH having a temperature of approximately 40° C. for approximately 1 minute.

Figure 5:
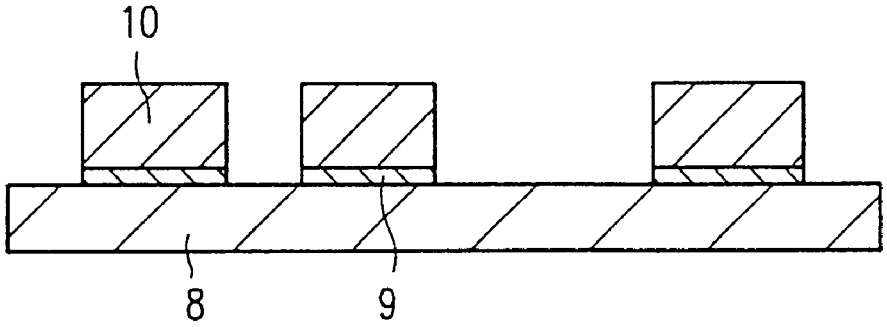

After the plating resist pattern 11 is removed, the release layer 9 is treated by soft etching for a short period of time (several seconds) with a 5% solution of nitric acid to leave the Ag conductive pattern 10 on the base plate 8 as is shown in FIG. 5. The lamination of the release layer 9 and the Ag conductive pattern 10 corresponds to the conductive patterns 2 and 5. As the soft etchant, a sulfuric acid bath of chromic anhydride, a hydrochloric acid bath of an iron chloride ($FeCl_2$), or the like can be also used. Since soft etching is performed only for several seconds, the release layer beneath the Ag conductive pattern 10 is not removed. Thus, the Ag conductive pattern 10 is not removed.

[Formation of the magnetic sheets]

Hereinafter, a method for forming the magnetic sheets 1, 3 and 6 will be described.

A resin such as a butyral resin, an acrylic resin or ethylcellulose, and a plasticizer such as dibutylphthalate are dissolved in an alcohol having a low boiling point such as isopropylalcohol or butanol, or in a solvent such as toluene or xylene to obtain a vehicle. The vehicle and a Ni.Zn.Cu type ferrite powder having an average diameter of approximately 0.5 to 2.0 $\mu$m are kneaded together to form a ferrite paste (slurry). A PET film is coated with the ferrite paste using a doctor blade and then dried at 80 to 100° C. until slight tackiness is left.

The magnetic sheets 1 and 6 are each formed to have a thickness of 0.3 to 0.5 mm, and the magnetic sheet 3 is formed to have a thickness of 20 to 100 $\mu$m. Then, the magnetic sheet 3 is punched to form the through-hole 4 having a side which is approximately 0.15 to 0.3 mm long.

[Transfer of the conductive patterns]

Next, a method for transferring the conductive patterns 2 and 5 on the magnetic sheets 1 and 6 and laminating the magnetic sheets 1, 3 and 6 will be described.

The base plate 8 having the conductive pattern 2 is pressed on the magnetic sheet 1 formed on the PET film. When necessary, pressure and heat are provided. In an alternative manner, the magnetic sheet 1 is released from the PET film and the base plate 8 having the conductive pattern 2 is pressed on a surface of the magnetic sheet 1 having tackiness (the surface which has been in contact with the PET film).

The conductive pattern 2 has appropriate releasability from the base plate 8 and also has appropriate adhesion (tackiness) with the magnetic sheet 1. Thus, the conductive pattern 2 can be transferred on the magnetic sheet 1 easily by peeling off the magnetic sheet 1 from the base plate 8.

In the case where the mechanical strength of the magnetic sheet 1 is insufficient, an additional strength can be provided by forming a viscous sheet on the magnetic sheet 1.

In the same manner, the conductive pattern 5 is transferred on the magnetic sheet 6.

The magnetic sheet 3 is located between the magnetic sheet 1 having the conductive pattern 2 and the magnetic sheet 6 having the conductive pattern 5. The magnetic sheets 1, 3 and 6 are laminated so that the conductive patterns 2 and 5 are connected to each other via the through-hole 4 to form a conductor coil. The adherence between the magnetic sheets 1, 3 and 6 of the resultant lamination body are strengthened by heat (60 to 120° C.) and pressure (20 to 500 $kg/cm^2$), and thus the lamination body is formed into an integral body.

Figure 13:
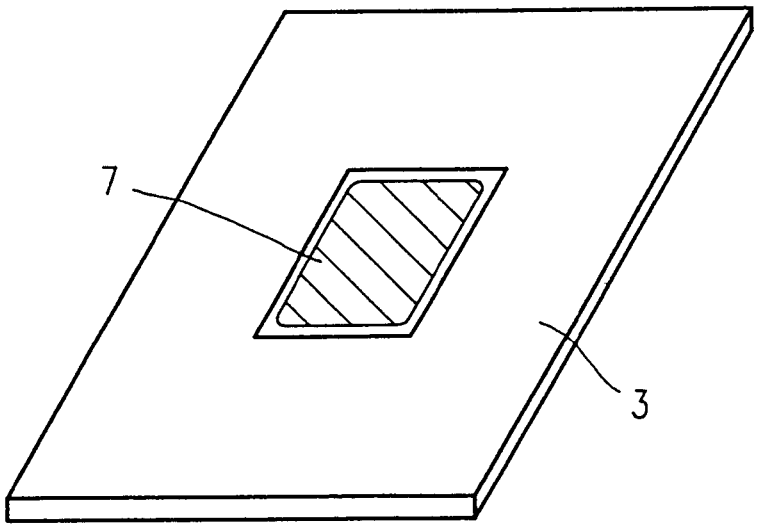
FIG. 13 is an isometric view illustrating a modification of the lamination ceramic chip inductor in the first example.

Connecting the two conductive patterns 2 and 5 through a thick film conductor provides better ohmic electric connection. Accordingly, a printed thick film conductor 7 is preferably provided in the through-hole 4 of the magnetic sheet 3 as is shown in FIG. 13.

Usually in the above-described process, a plurality of conductive patterns are formed on one magnetic sheet, and the magnetic sheets are laminated in the state of having the plurality of conductive patterns, in order to mass-produce inductors with higher efficiency. After the integral bodies are formed, the resultant greensheet is cut into a plurality of integral bodies, and each integral body is sintered at a temperature of 850 to 950° C. for approximately 1 to 2 hours. The cutting can be performed after sintering.

An electrode of a silver alloy (for example, AgPd) is formed on each of two opposed side surfaces of each integral body and connected to the conductor coil. Then, the integral body is sintered at approximately 600 to 850° C. to form outer electrodes 12 shown in FIG. 6. When necessary, the outer electrodes 12 are plated with nickel, solder or the like.

In this manner, the inductor 100 having an outer size of 2.0 mm×1.25 mm and a thickness of approximately 0.8 mm is obtained. The conductor coil, which includes the two conductive patterns 2 and 5 each having 2.5 turns, has 5 turns in total. Accordingly, an impedance of approximately 700 Ω is obtained at a frequency of 100 MHz. The DC resistance can be as small as approximately 0.12 Ω because the thickness of the conductor coil is as much as approximately 50 $\mu$m.

The inductor 100 was cut for examination. No specific gap was found at the interfaces between the conductor coil and the magnetic sheets. The probable reason is that: in contrast to a conductor coil formed of thick film conductive patterns, the conductor coil produced by electroforming according to the present invention scarcely shrinks from sintering and thus is surrounded by the sintered magnetic body with a high density.

The material for the magnetic sheets used in the present invention is not limited to the one used in this example. Although a magnetic sheet is preferably used in order to obtain a high impedance, an insulation sheet having dielectricity can also be used.

EXAMPLE 2

Figure 7:
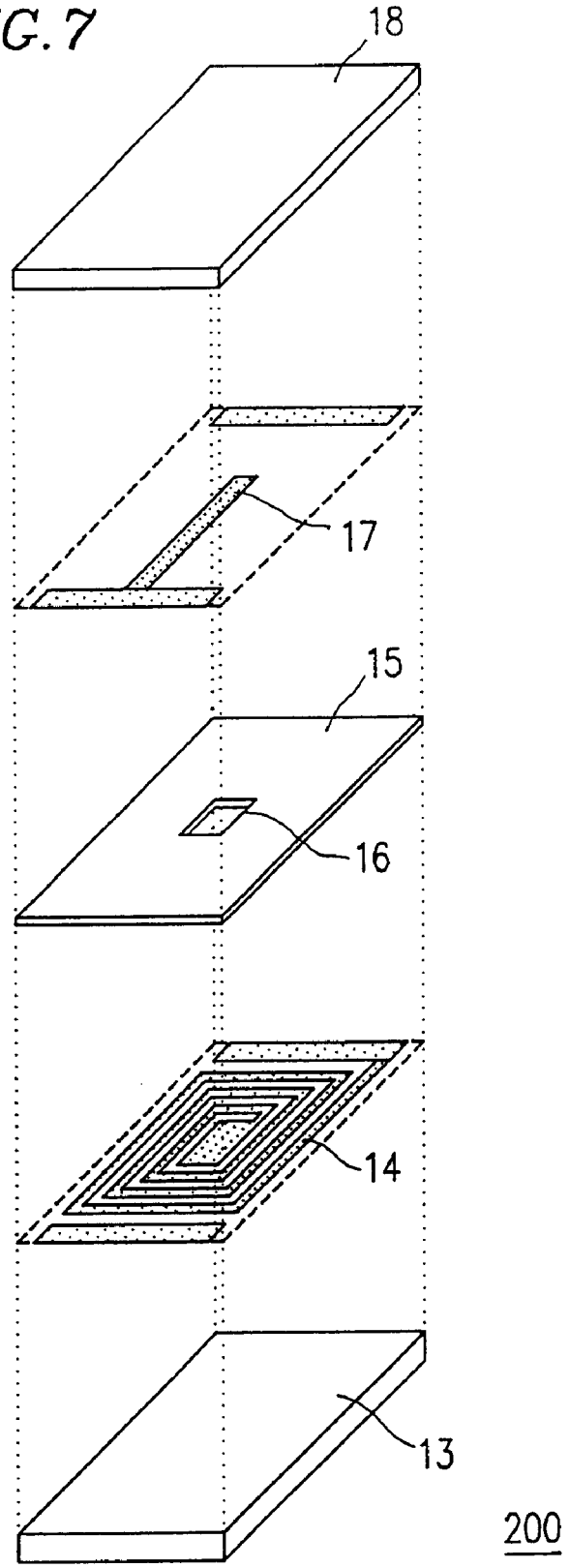
FIG. 7 is an exploded isometric view of a lamination ceramic chip inductor in second, fifth and sixth examples according to the present invention.

A lamination ceramic chip inductor 200 in a second example according to the present invention will be described with reference to FIG. 7. FIG. 7 is an exploded isometric view of the inductor 200.

The inductor 200 includes a plurality of magnetic sheets 13, 15 and 18, a coil-shaped plated conductive pattern 14 formed by electroforming and transferred onto the magnetic sheet 13, and a thick film conductive pattern 17 printed on the magnetic sheet 15 having a through-hole 16.

The conductive patterns 14 and 17 are connected to each other via the through-hole 16.

A method for producing the inductor 200 will be described.

First, the plated conductive pattern 14 is produced by electroforming in the same manner as in the first example. In this example, the plated conductive pattern 14 having a width of approximately 40 $\mu$m, a thickness of approximately 35 $\mu$m, and approximately 3.5 turns is formed on an area of approximately 1.6 mm×0.8 mm. The photoresist used for forming the plated conductive pattern 14 is of a paste type, is printable, and has high sensitivity.

Hereinafter, a method for forming the magnetic sheets 13, 15 and 18 will be described.

A resin such as a butyral resin, an acrylic resin or ethylcellulose, and a plasticizer such as dibutylphthalate are dissolved in a solvent having a high boiling point such as terpineol to obtain a vehicle. The vehicle and a Ni.Zn.Cu type ferrite powder having an average diameter of approximately 0.5 to 2.0 $\mu$m are kneaded together to form a ferrite paste. The ferrite paste is printed on a PET film using a metal mask and then dried at approximately 80 to 100° C. until the thickness of the ferrite paste becomes approximately 0.3 to 0.5 mm. Thus, the magnetic sheets 13 and 18 are obtained. When necessary, printing and drying are repeated a plurality of times.

Alternatively, the magnetic sheets 13 and 18 can be obtained by laminating a plurality of magnetic sheets, each of which has a ferrite paste having a thickness of approximately 50 to 100 $\mu$m printed thereon and dried.

The magnetic sheet 15 is produced by forming a pattern having the through-hole 16 on a PET film by screen printing. The thickness of the magnetic sheet 15 is adjusted to be approximately 40 to 100 $\mu$m.

Next, a method for transferring the plated conductive pattern 14 on the magnetic sheet 13 will be described.

The base plate 8 having the plated conductive pattern 14 is pressed on the magnetic sheet 13 formed on the PET film. The pressure is preferably in the range of 20 to 500 kg/cm$^2$, and the heating temperature is preferably in the range of 60 to 120° C.

The plated conductive pattern 14 has appropriate releasability from the base plate 8 and also has appropriate adhesion with the magnetic sheet 13. Further, the plated conductive pattern 14 has a relatively small width of 40 $\mu$m and thus is slightly buried in the magnetic sheet 13. For these reasons, the plated conductive pattern 14 can be transferred on the magnetic sheet 13 easily by peeling off the magnetic sheet 13 from the base plate 8.

Alternatively, the plated conductive pattern 14 can be transferred by releasing the magnetic sheet 13 from the PET film and pressing the base plate 8 having the plated conductive pattern 14 on a surface of the magnetic sheet 13 film which has been in contact with the PET film as in the first example.

Then, the thick film conductive pattern 17 is printed on the magnetic sheet 15 having the through-hole 16.

The magnetic sheet 13 having the plated conductive pattern 14 and the magnetic sheet 15 having the thick film conductive pattern 17 are laminated so that the conductive patterns 14 and 17 are connected to each other via the through-hole 16 to form a conductor coil. The magnetic sheet 18 is laminated on the magnetic sheet 15 having the thick film conductive pattern 17, and the resultant lamination body is heated (60 to 120° C.) and pressurized (20 to 500 kg/cm$^2$) to be formed into an integral body.

Usually in the above-described process, a plurality of conductive patterns are formed on one magnetic sheet, and the magnetic sheets are laminated in the state of having the plurality of conductive patterns, in order to mass-produce inductors with higher efficiency. After the integral bodies are formed, the resultant greensheet is cut into a plurality of integral bodies, and each integral body is sintered at a temperature of 850 to 950° C. for approximately 1 to 2 hours.

An electrode of a silver alloy (for example, AgPd) is formed on each of two opposed side surfaces of each integral body and connected to the conductor coil. Then, the integral body is sintered at approximately 600 to 850° C. to form outer electrodes 12 shown in FIG. 6. When necessary, the outer electrodes 12 are plated with nickel, solder or the like.

In this manner, the inductor 200 having an outer size of approximately 1.6 mm×0.8 mm and a thickness of approximately 0.8 mm is obtained. The conductor coil, having a total number of turns of 3.5, includes the plated conductive pattern 14 having approximately 3.5 turns and the thick film conductive pattern 17. Accordingly, an impedance of approximately 300 Ω is obtained at a frequency of 100 MHz. The DC resistance can be as small as approximately 0.19 Ω because the thickness of the conductor coil is as much as approximately 35 $\mu$m.

In the second example, the conductive coil includes only two conductive patterns 14 and 17. When necessary, a plurality of coil-shaped conductive patterns 14 and a plurality of thick film conductive patterns 17 can be connected alternately.

Connection between the coil-shaped conductive pattern 14 and the thick film conductive pattern 17 is more reliable than the direct connection between coil-shaped conductive patterns. The probable reason is that: since the thick film conductive pattern is easily strained during the lamination, the lamination body is sintered in the state where the adherence between the coil-shaped conductive pattern and the thick film conductive pattern is strengthened.

EXAMPLE 3

Figure 8:
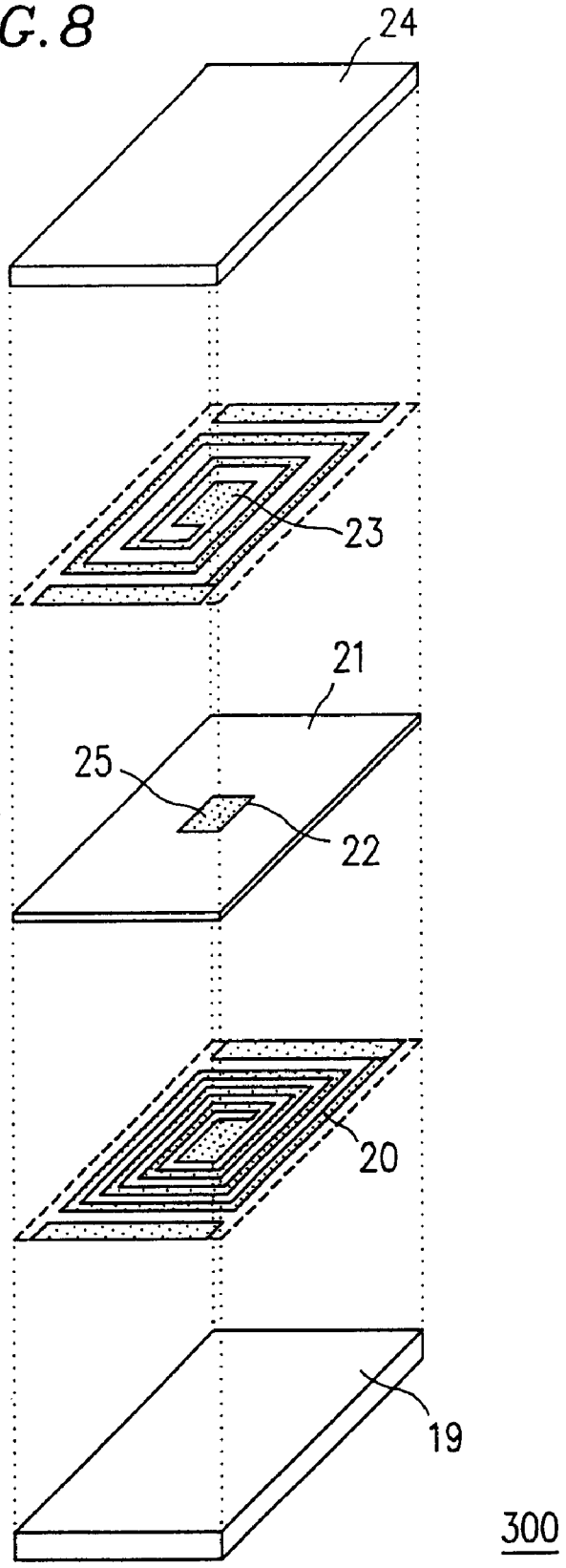
FIG. 8 is an exploded isometric view of a lamination ceramic chip inductor in a third example according to the present invention.

A lamination ceramic chip inductor 300 in a third example according to the present invention will be described with reference to FIG. 8. FIG. 8 is an exploded isometric view of the inductor 300.

The inductor 300 includes a plurality of magnetic sheets 19, 21 and 24 and coil-shaped plated conductive patterns 20 and 23 formed by electroforming and respectively transferred on the magnetic sheets 19 and 24.

The conductive patterns 20 and 23 are connected to each other via a through-hole 22 formed in the magnetic sheet 21. The through-hole 22 is filled with a thick film conductor 25.

A method for producing the inductor 300 will be described.

First, the conductive patterns 20 and 23 are produced by electroforming in the same manner as in the first example. In this example, the conductive patterns 20 and 23 each having a width of approximately 40 $\mu$m and a thickness of 35 $\mu$m are formed on an area of approximately 1.6 mm×0.8 mm. The conductive pattern 20 has approximately 3.5 turns, and the conductive pattern 23 has approximately 2.5 turns. The photoresist used for forming the conductive patterns 20 and 23 is of a paste type, is printable, and has high sensitivity.

Hereinafter, a method for forming the magnetic sheets 19, 21 and 24 will be described.

A resin such as a butyral resin, an acrylic resin or ethylcellulose, and a plasticizer such as dibutylphthalate are dissolved in a solvent having a high boiling point such as terpineol to obtain a vehicle. The vehicle and a Ni.Zn.Cu type ferrite powder having an average diameter of approximately 0.5 to 2.0 $\mu$m are kneaded together to form a ferrite paste. The ferrite paste is printed on a PET film using a metal mask and then dried at approximately 80 to 100° C. until slight tackiness is left. Thus, the magnetic sheets 19 and 24 each having a thickness of approximately 0.3 to 0.5 mm are obtained. The magnetic sheet 21 is produced by forming a pattern having the through-hole 22 on the PET film by screen printing, and the thickness thereof is adjusted to be approximately 40 to 100 $\mu$m.

Then, the thick film conductor 25 is formed in the through-hole 22 by printing.

Next, a method for transferring the conductive patterns 20 and 23 on the magnetic sheets 19 and 24 and laminating the magnetic sheets 19, 21 and 24 will be described.

The base plate 8 having the conductive pattern 20 is pressed to transfer the conductive pattern 20 onto the magnetic sheet 19 formed on the PET film. When necessary, pressure and heat are provided. The conductive pattern 23 is transferred on the magnetic sheet 24 in the same manner. The conductive pattern 23 can be transferred on the magnetic sheet 21.

The magnetic sheet 21 is located between the magnetic sheet 19 having the conductive pattern 20 and the magnetic sheet 24 having the conductive pattern 23. The magnetic sheets 19, 21 and 24 are laminated so that the conductive patterns 20 and 23 are connected to each other via the through-hole 22 to form a conductor coil. Then, the resultant lamination body is heated (60 to 120° C.) and pressurized (20 to 500 kg/cm$^2$) to be formed into an integral body.

Usually in the above-described process, a plurality of conductive patterns are formed on one magnetic sheet, and the magnetic sheets are laminated in the state of having the plurality of conductive patterns, in order to mass-produce inductors with higher efficiency. After the integral bodies are formed, the resultant greensheet is cut into a plurality of integral bodies, and each integral body is sintered at a temperature of 850 to 1,000° C. for approximately 1 to 2 hours.

An electrode formed of a silver alloy (for example, AgPd) is formed on each of two opposed side surfaces of each integral body and connected to the conductor coil. Then, the integral body is sintered at approximately 600 to 850° C. to form outer electrodes 12 shown in FIG. 6. When necessary, the outer electrodes 12 are plated with nickel, solder or the like.

In this manner, the inductor 300 having an outer size of approximately 1.6 mm×0.8 mm and a thickness of approximately 0.8 mm is obtained. The conductor coil includes the conductive patterns 20 and 23 each having a width of approximately 40 μm. The conductive pattern 20 has approximately 3.5 turns, and the conductive pattern 23 has approximately 2.5 turns. The total number of turns is 6. Accordingly, an impedance of approximately 1,000 Ω is obtained at a frequency of 100 MHz. The DC resistance can be as small as approximately 0.32 Ω because the thickness of the conductor coil is as much as approximately 35 μm.

EXAMPLE 4

Figure 9:
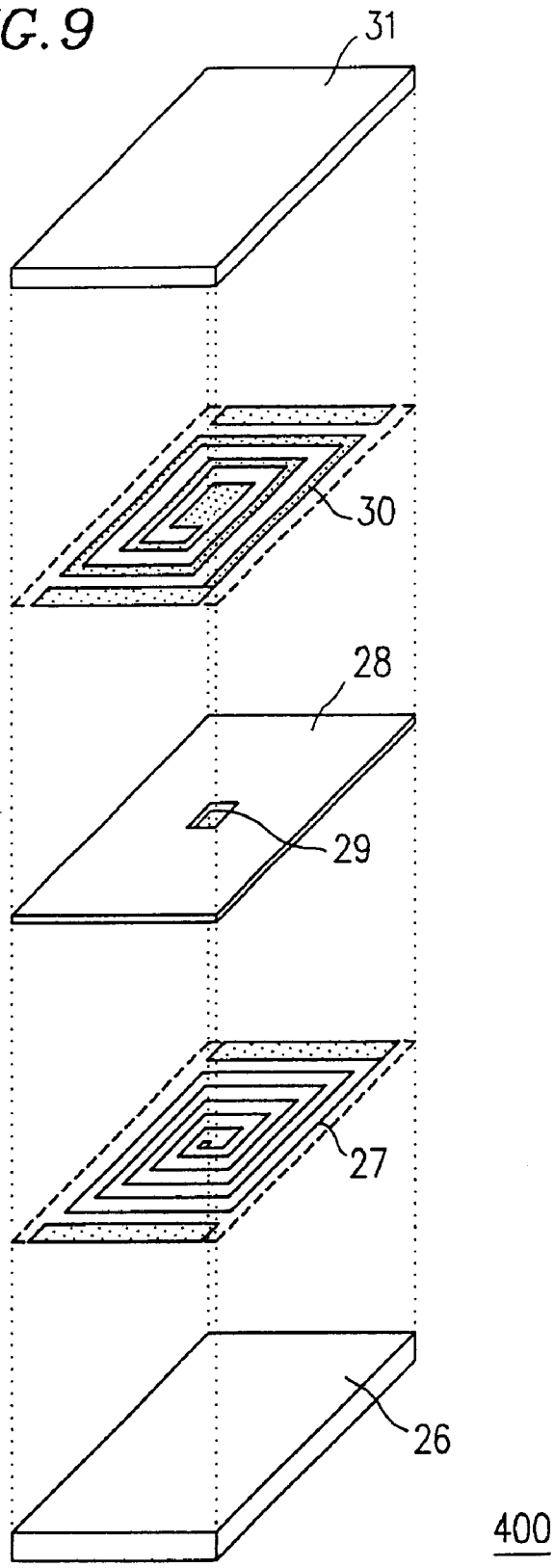
FIG. 9 is an exploded isometric view of a lamination ceramic chip inductor in a fourth example according to the present invention.

A lamination ceramic chip inductor 400 in a fourth example according to the present invention will be described with reference to FIG. 9. FIG. 9 is an exploded isometric view of the inductor 400.

The inductor 400 includes a plurality of magnetic sheets 26, 28 and 31 and coil-shaped plated conductive patterns 27 and 30 formed by electroforming and respectively transferred onto the magnetic sheets 26 and 31.

The conductive patterns 27 and 30 are connected to each other via a through-hole 29 formed in the magnetic sheet 28.

The inductor 400 has the same structure as the inductor 100 in the first example except that the width of the conductive pattern 27 is 40 μm.

In this example, the inductor 400 having an outer size of approximately 2.0 mm×1.25 mm and a thickness of approximately 0.8 mm is obtained. The conductor coil includes the conductive pattern 27 having a width of approximately 40 μm and approximately 5.5 turns and the conductive pattern 30 having a width of approximately 70 μm and approximately 2.5 turns. The total number of turns is 8. Accordingly, an impedance of approximately 1,400 Ω is obtained at a frequency of 100 MHz. The DC resistance can be as small as approximately 0.47 Ω because the thickness of the conductor coil is approximately 35 μm.

EXAMPLE 5

A lamination ceramic chip inductor in a fifth example according to the present invention, which has the same structure as that of the inductor 200 in the second example, will be described with reference to FIG. 7. The inductor 200 includes a plurality of magnetic sheets 13, 15 and 18, a coil-shaped conductive pattern 14 formed by electroforming and transferred onto the magnetic sheet 13, and a thick film conductive pattern 17 printed on the magnetic sheet 15 having a through-hole 16. The conductive patterns 14 and 17 are connected to each other via the through-hole 16.

A method for producing the inductor in the fifth example will be described.

First, the plated conductive pattern 14 is produced by electroforming in the same manner as in the second example. The conductive pattern 14 having a width of approximately 40 μm, a thickness of approximately 35 μm, and approximately 3.5 turns is formed on an area of approximately 1.6 mm×0.8 mm. The photoresist used for forming the plated conductive pattern 14 is of a paste type, is printable, and has high sensitivity.

Figure 10:
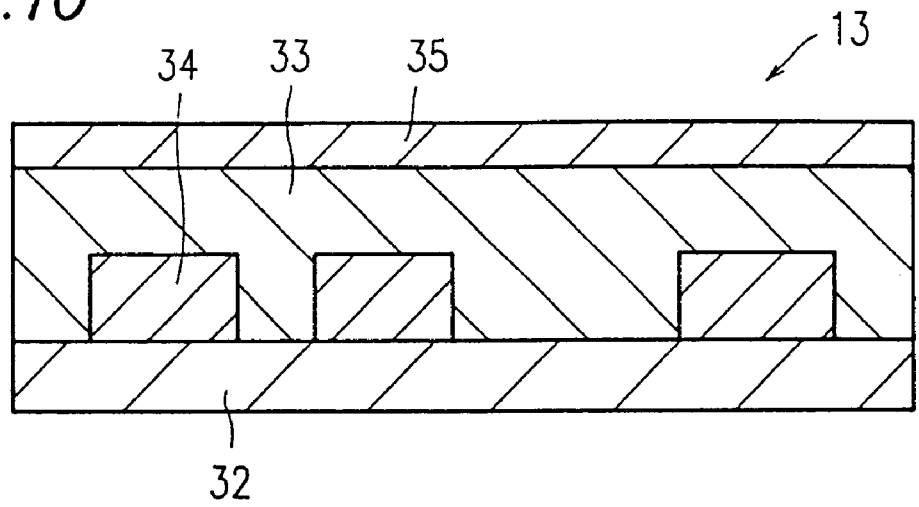
FIG. 10 is a cross sectional view illustrating a step for producing the lamination ceramic chip inductor in the fifth example.

Hereinafter, a method for forming the magnetic sheet 13 will be described with reference to FIG. 10.

A resin such as a butyral resin, an acrylic resin or ethylcellulose, and a plasticizer such as dibutylphthalate are dissolved in a solvent having a high boiling point such as terpineol to obtain a vehicle. The vehicle and a Ni.Zn.Cu type ferrite powder having an average diameter of approximately 0.5 to 2.0 μm are kneaded together to form a ferrite paste. The ferrite paste is printed on a stainless steel base plate 32 having an Ag conductive pattern 34 (corresponding to the plated conductive pattern 14) thereon using a metal mask and then dried at 80 to 100° C. until the thickness of the ferrite paste becomes approximately 0.3 to 0.5 mm. Thus, a magnetic sheet 33 is formed. When necessary, printing and drying are repeated a plurality of times.

Next, a thermally releasable sheet 35 is pasted on the magnetic sheet 33, with pressure and heat when necessary. The lamination of the Ag conductive pattern 34, the magnetic sheet 33, and the thermally releasable sheet 35 is peeled off from the base plate 32. In this manner, a greensheet having the Ag conductive pattern 34 buried in the magnetic sheet 33 is obtained. The thermally releasable sheet 35 is peeled off by heating (for example, 120° C.).

When necessary, before the formation of the Ag conductive pattern 34, a release layer can be formed on the base plate 32 as in the first example. By providing the release layer, the releasability between the magnetic sheet 33 and the base plate 32 is improved. The release layer is formed by dip-coating the base plate 32 with a liquid fluorine coupling agent (for example, perfluorodecyltriethoxysilane) and drying the resultant lamination body at a temperature 200° C. The thickness of the release layer is preferably approximately 0.1 μm.

The magnetic sheet 15 is formed on the PET film by screen printing so as to have the through-hole 16. The thickness of the magnetic sheet 15 is adjusted to be approximately 40 to 100 μm, and the magnetic sheet 15 is formed on the magnetic sheet 13 having the plated conductive pattern 14.

For the lamination, the pressure is preferably in the range of 20 to 500 kg/cm$^2$; and the heating temperature is preferably in the range of 80 to 120° C.

In this example, the plated conductive pattern 14 is buried in the magnetic sheet 13 and has very little ruggedness.

Accordingly, the magnetic sheet 15 can be easily formed on the magnetic sheet 13.

After the plated conductive pattern 14 is transferred on the magnetic sheet 13, the thick film conductive pattern 17 is printed on the magnetic sheet 15 so as to be connected to the conductive pattern 14 via the through-hole 16. Then, The magnetic sheet 18 is laminated on the magnetic sheet 15 having the thick film conductive pattern 17. The resultant lamination body is heated (80 to 120°C.) and pressurized (20 to 500 kg/cm$^2$) to be formed into an integral body. The magnetic sheet 18 can be directly printed on the magnetic sheet 15 having the thick film conductive pattern 17.

The resultant greensheet is cut into a plurality of integral bodies, sintered, and provided with two electrodes for each integral body in the same manner as in the second example.

The electric characteristics of the inductor produced in the fifth example are the same as those of the inductor 200 in the second example.

EXAMPLE 6

A lamination ceramic chip inductor in a sixth example according to the present invention, which has the same structure as those of the inductors 200 in the second and the fifth examples, will be described with reference to FIG. 7. The inductor 200 includes a plurality of magnetic sheets 13, 15 and 18, a coil-shaped plated conductive pattern 14 formed by electroforming and transferred on the magnetic sheet 13, and a thick film conductive pattern 17 printed on the magnetic sheet 15 having a through-hole 16. The conductive patterns 14 and 17 are connected to each other via the through-hole 16.

Hereinafter, a method for transferring the plated conductive pattern 14 on the magnetic sheet 13 in the sixth example will be described with reference to FIGS. 11A through 11E.

Figure 11A:
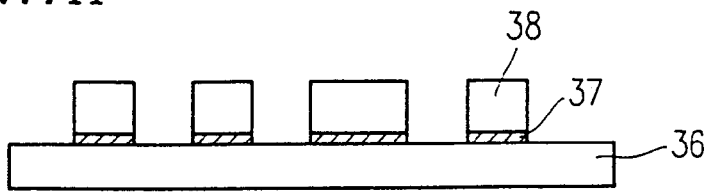
FIG. 11A through 11E are cross sectional views illustrating a method for producing the lamination ceramic chip inductor in the sixth example.

First, as is shown in FIG. 11A, an Ag conductive pattern 38 is formed on a stainless steel base plate 36. In this example, the Ag conductive pattern 38 having a width of approximately 40 $\mu$m, a thickness of approximately 35 $\mu$m, and approximately 3.5 turns is formed on an area of approximately 1.6 mm×0.8 mm of the base plate 36 in the state of interposing a release layer 37 therebetween. The release layer 37 is formed by strikeplating the base plate 36 with Ag. The lamination of the release layer 37 and the Ag conductive pattern 38 corresponds to the plated conductive pattern 14.

Figure 11B:
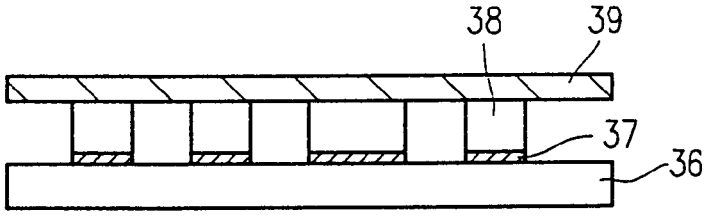

Then, as is shown in FIG. 11B, a foam sheet 39 is attached to the Ag conductive pattern 38 by performing heating and foaming from above. The foam sheet 39 is thermally releasable from the base plate 36. When necessary, additional heat and pressure are provided.

Figure 11C:
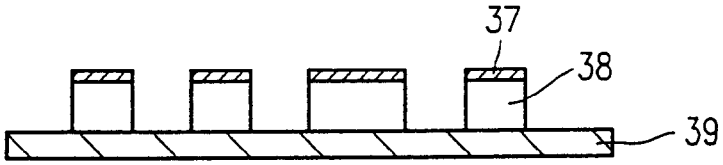

Since the foam sheet 39 has high adhesion. Thus, when the foam sheet 39 is peeled off from the base plate 36, the Ag conductive pattern 38 and the release layer 37 are also peeled off and thus transferred onto the foam sheet 39 as is shown in FIG. 11C.

Figure 11D:
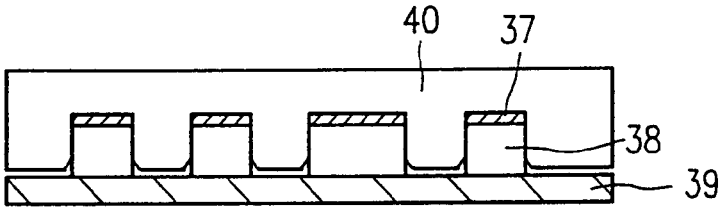

Then, as is shown in FIG. 11D, a magnetic sheet 40 (corresponding to the magnetic sheet 13) formed on a PET film or the like by printing or the like having a thickness of approximately 50 to 500 $\mu$m is laminated on the release layer 37 so that a surface of the magnetic sheet 40 having plasticity is in contact with the release layer 37. Then, more magnetic sheets 40 are laminated thereon until the total thickness of the magnetic sheets 40 becomes approximately 0.3 to 0.5 mm. When necessary, appropriate heat and pressure are provided for lamination.

Figure 11E:
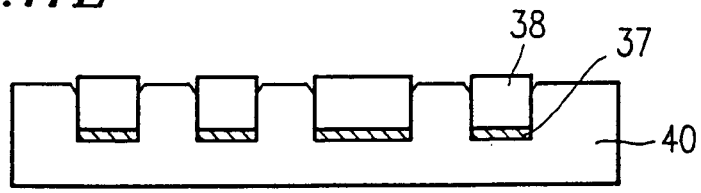

The resultant lamination body is heated at a temperature of approximately 120° C. for approximately 10 minutes, and the foam sheet 39 is foamed to be released. In this manner, the Ag conductive pattern 38 (corresponding to the plated conductive pattern 14) is transferred on the magnetic sheet 40 (corresponding to the magnetic sheet 13) as is shown in FIG. 11E.

Returning to FIG. 7, the magnetic sheet 15 having the through-hole 16 is laminated or printed on the magnetic sheet 13 having the plated conductive pattern 14. Then, the thick film conductive pattern 17 is laminated or printed on the magnetic sheet 15 to be connected with the plated conductive pattern 14 via the through-hole 16.

The magnetic sheet 18 is laminated on the magnetic sheet 15 having the thick film conductive pattern 17 thereon, and the resultant lamination body is supplied with heat (for example, 60 to 120° C.) and pressure (for example, 20 to 500 kg/cm$^2$) to be formed into an integral body. The magnetic sheet 18 can be printed directly onto the magnetic sheet 15.

The greensheet produced in this manner is cut into a plurality of integral bodies, sintered, and provided with two electrodes for each integral body in the same manner as in the second example.

The electric characteristics of the inductor produced in the sixth example are equal to those of the inductor 200 in the second example.

In the first through sixth examples, coil-shaped conductive patterns are formed by electroforming. Alternatively, a plurality of straight conductive patterns can be connected to form a conducive coil.

EXAMPLE 7

A lamination ceramic chip inductor 700 in a seventh example according to the present invention will be described with reference to FIG. 12.

Figure 12:
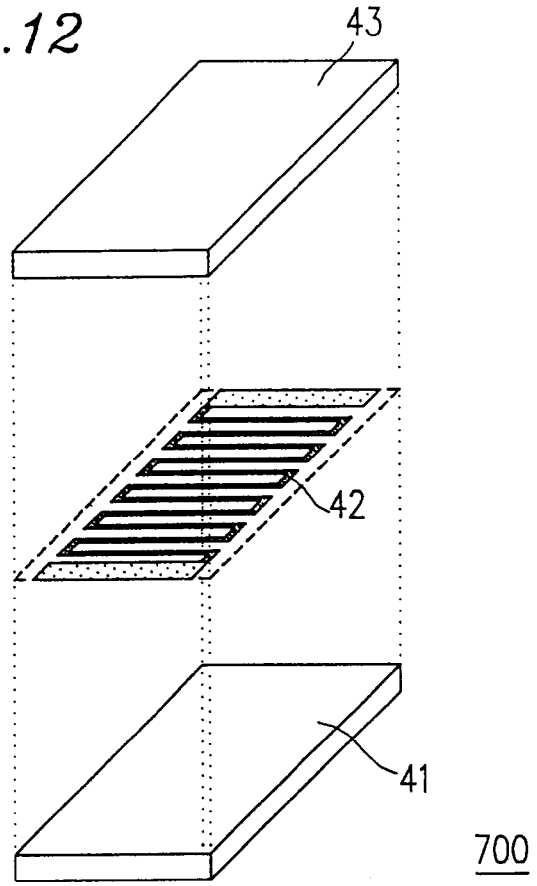
FIG. 12 is an exploded isometric view of a lamination ceramic chip inductor in a seventh example according to the present invention.

FIG. 12 is an exploded isometric view of the inductor 700. The inductor 700 includes a plurality of magnetic sheets 41 and 43 and a wave-shaped plated conductive pattern 42 formed by electroforming. The wave-shaped conductive pattern 42 is drawn to edge surfaces of the chip.

The inductor 700 having the above-described structure is formed in the same manner as in the first example.

The inductor 700 has an outer size of approximately 2.0 mm×1.25 mm and a thickness of approximately 0.8 mm. The wave-shaped conductive pattern 42 has a width of approximately 50 $\mu$m and runs along a longitudinal direction of the magnetic sheets 41 and 43. The impedance of approximately 120 Ω is obtained at a frequency of 100 MHz.

The DC resistance can be as small as approximately 0.08 Ω because the thickness of the conductive pattern 42 is as much as approximately 35 $\mu$m.

In the above seven examples, the conductive patterns are formed of Ag. If price, specific resistance or resistance against acid need not be considered, Au, Pt, Pd, Cu, Ni or the like and alloys thereof can be used.

In the above seven examples, the sheets to be laminated are formed of a magnetic material containing Ni.Zn.Cu. Needless to say, a lamination ceramic chip inductor having an air-core coil characteristic can be produced using a Ni.Zn or Mn.Zn material, an insulation material having a low dielectric constant, or the like.

EXAMPLE 8

A lamination ceramic chip inductor 800 in an eighth example according to the present invention will be described with reference to FIGS. 15, 16A, 16B, 17A and 17B. FIG.

15 is an exploded isometric view of the lamination ceramic chip inductor 800.

Figure 15:
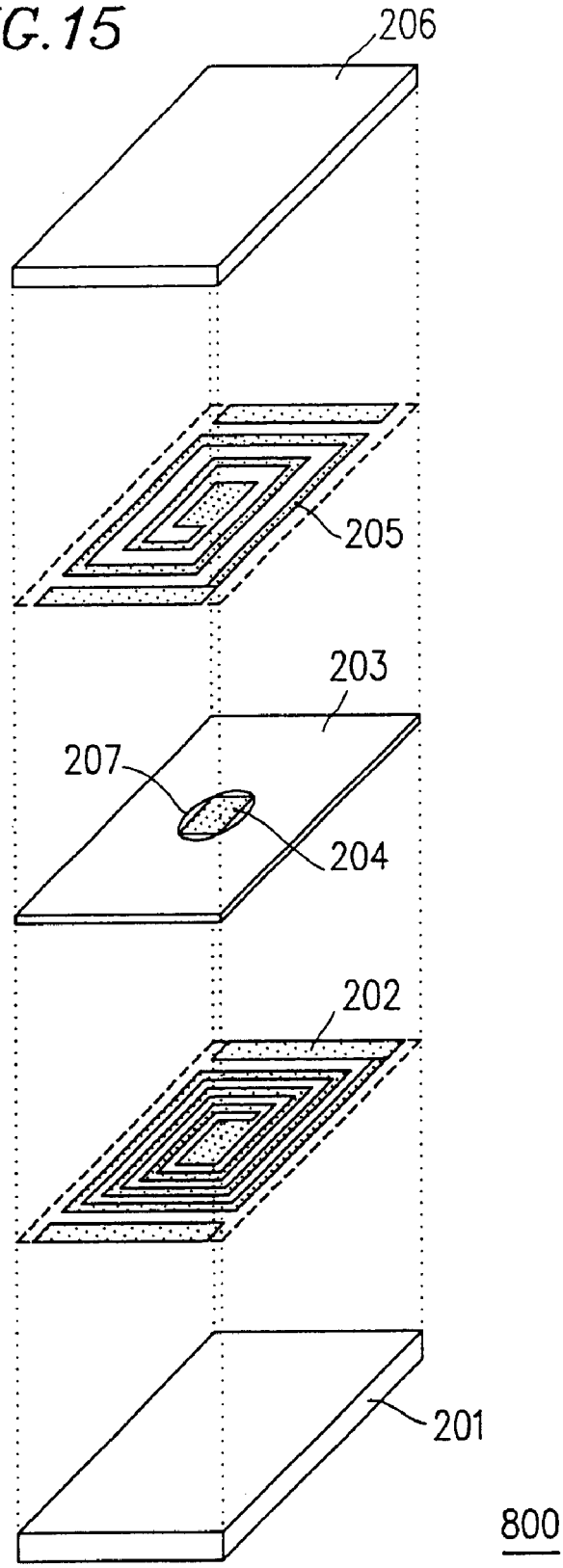
FIG. 15 is an exploded isometric view of a lamination ceramic chip inductor in an eighth example according to the present invention.

The inductor 800 shown in FIG. 15 includes a plurality of magnetic sheets 201, 203 and 206, and a plurality of coil-shaped plated conductive patterns 202 and 205 formed by electroforming. The magnetic sheet 203 has a conductive bump 204 formed by electroforming in a through-hole 207 thereof.

The magnetic sheets 201 and 206 respectively have the conductive patterns 202 and 205 transferred thereon. The conductive patterns 202 and 205 are connected to each other via the conductive bump 204.

A method for producing the inductor 800 will be described.

[Formation of the conductive patterns]

Figure 16A:
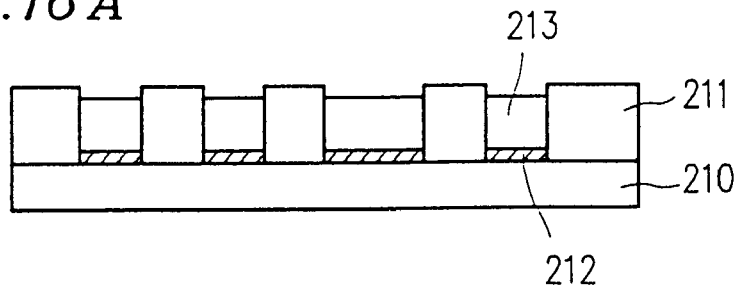
FIGS. 16A, 16B, 17A and 17B are cross sectional views illustrating a method for producing the lamination ceramic chip inductor in the eighth example.
Figure 16B:
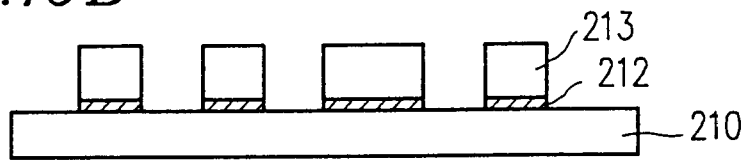

First, how to form the conductive patterns 202 and 205 will be described with reference to FIGS. 16A and 16B.

On a stainless steel base plate 210, a liquid photoresist is screen-printed and dried at a temperature of approximately 100° C. to form a photoresist film 211 having a thickness of approximately 25 μm. The resultant lamination is exposed to collimated light using the photoresist film 211 as a mask and immediately developed. In this example, the development is performed using an aqueous solution of sodium carbonate. After the development, the resultant lamination is sufficiently rinsed and activated with an acid by, for example, immersing the lamination in a 5% solution of $H_2SO_4$ for 0.5 to 1 minute. Then, the resultant lamination is treated with strike plating using a neutral Ag plating material containing no cyanide (for example, Dain Silver Bright AG-PL 30 produced by Daiwa Kasei Kabushiki Kaisha) for approximately 1 minute at a current density of 0.3 A/dm$^2$ to form a release layer 212 having a thickness of approximately 0.1 μm. Immediately thereafter, the resultant lamination is further immersed in an Ag plating bath containing no cyanide (using, for example, Dain Silver Bright AG-PL 30 produced by Daiwa Kasei Kabushiki Kaisha) at a pH value of 1.0 (acid) for approximately 20 minutes at a current density of approximately 1 A/dm$^2$. The pH value of the Ag bath is adjustable in the range of approximately 1.0 to 8.0. In this manner, an Ag layer 213 having a thickness of 20 μm is obtained as is shown in FIG. 16A. The lamination of the release layer 212 and the Ag layer 213 corresponds to the conductive patterns 202 and 205 and the conductive bump 204. The Ag plating bath containing no cyanide used in this example has no toxicity, and thus provides safety and simplifies the disposal process of the waste fluid. As a result, improvement in the operation efficiency and reduction in production cost are achieved.

After the formation of the Ag layer 213, the photoresist film 211 is removed by immersion in a 5% solution of NaOH. The conductive patterns 202 and 205 thus obtained each have a thickness of approximately 20 μm, a width of approximately 35 μm, a space between lines of approximately 25 μm, and approximately 2.5 turns. Such conductive patterns 202 and 205 are suitable for a magnetic sheet having a size of 16 mm×0.8 mm. The conductive bump 204 thus obtained has a thickness of approximately of 20 μm and a planar size suitable for a through-hole having a diameter of 0.1 mm.

[Formation of the magnetic sheets]

Figure 17A:
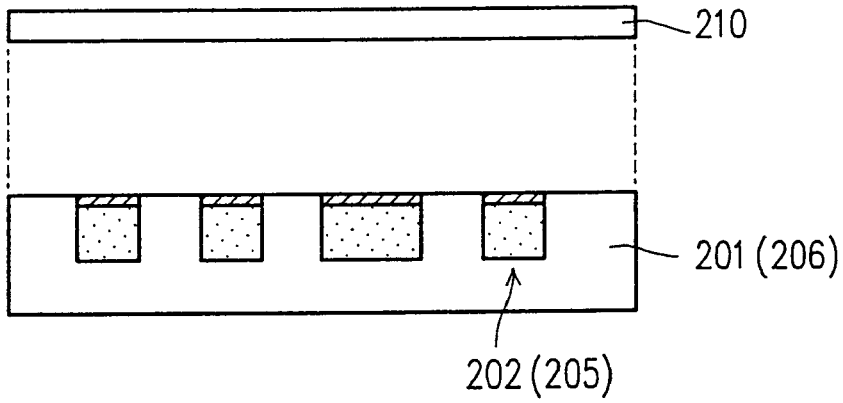
Figure 17B:
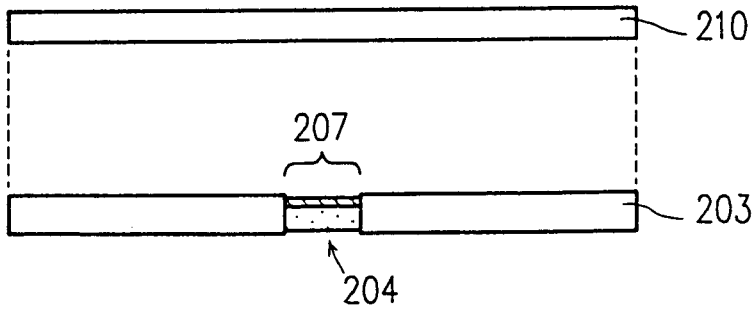

Hereinafter, a method for forming the magnetic sheets 201, 203 and 206 will be described with reference to FIGS. 17A and 17B.

A resin such as a butyral resin, an acrylic resin or ethylcellulose, and a plasticizer such as dibutylphthalate are dissolved in a solvent having a low boiling point such as toluene or xylene together with a small amount of additive to obtain a vehicle. The vehicle and a Ni.Zn.Cu type ferrite powder having an average diameter of approximately 1.2 to 2.7 μm are mixed together in a pot to form a ferrite paste (slurry). The ferrite powder is obtained as a result of pre-sintering at a high temperature (800 to 1,100° C.). A PET film is coated with the ferrite paste using a doctor blade to obtain greensheets having thicknesses of approximately 100 μm and approximately 40 μm.

Four such greensheets having a thickness of 100 μm are laminated to obtain a greensheet having a thickness of approximately 400 μm (corresponding to the magnetic sheets 201 and 206). The greensheet having a thickness of 40 μm is punched by a puncher (a device for mechanically forming a hole using a pin-type mold) to form the through-hole 207 having a diameter of approximately 0.1 mm. Thus, the magnetic sheet 203 is obtained.

[Transfer of the conductive patterns]

The magnetic sheets 201 and 206 are pressed on the base plate 210 having the conductive patterns 202 and 205 at a temperature of approximately 100° C. and a pressure of 70 kg/cm$^2$ for 5 seconds, and then the magnetic sheets 201 and 206 having the conductive patterns 202 and 205 buried therein are peeled off from the base plate 210. In this manner, the conductive patterns 202 and 205 are transferred onto the magnetic sheets 201 and 206 as is shown in FIG. 17A. The magnetic sheet 203 is pressed on the base plate 210 having the conductive bump 204 after positioning, and the magnetic sheet 203 having the conductive bump 204 is peeled off from the base plate 210. In this manner, the conductive bump 204 is transferred to the through-hole 207 in the magnetic sheet 203 as is shown in FIG. 17B.

The magnetic sheets 201, 203 and 206 are laminated so that the conductive patterns 202 and 205 are electrically connected to each other via the conductive bump 204.

Usually in the above-described process, a plurality of conductive patterns are formed on one magnetic sheet, and the magnetic sheets are laminated in the state of having the plurality of conductive patterns, in order to mass-produce inductors with higher efficiency. After the integral bodies are formed in the same manner as in the first example, the resultant greensheet is cut into a plurality of integral bodies, and each integral body is sintered at a temperature of 900 to 920° C. for approximately 1 to 2 hours.

Figure 6:
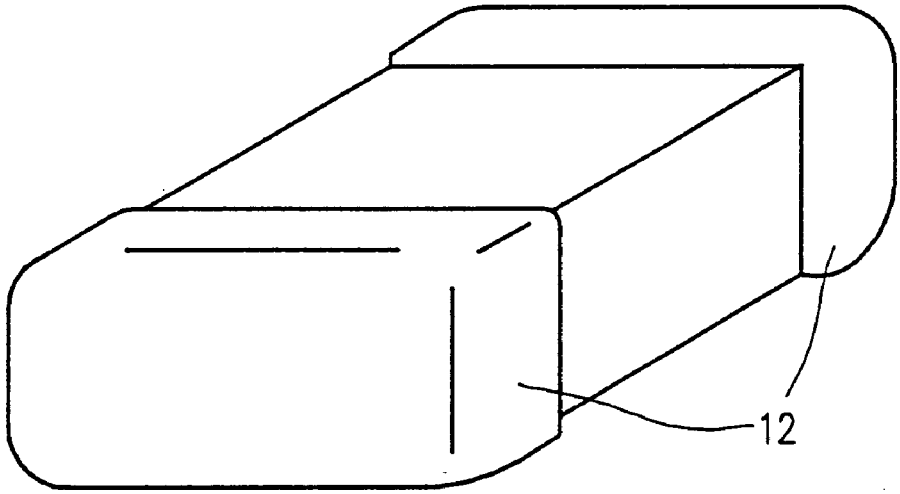
FIG. 6 is an isometric view of the lamination ceramic chip inductor produced in a method shown in FIGS. 2 through 5.

Then, outer electrodes 12 shown in FIG. 6 are formed in the same manner as in the first example. When necessary, burrs are removed, and the outer electrodes 12 are plated with nickel, solder or the like.

In this manner, the inductor 800 having an outer size of 1.6 mm×0.8 mm and a thickness of approximately 0.8 mm is obtained.

In general, in order to increase the density of the sintered magnetic body, a fine ferrite powder having a diameter of 0.2 to 1.0 μm and pre-sintered at 700 to 800° C. is used. Such a powder shrinks from sintering by 15 to 20%. The low-ratio shrinkage powder used in this example has grains having a diameter of 1 to 3 μm and pre-sintered at a high temperature (800 to 1,100° C.). Thus, the shrinkage ratio from sintering is restricted to 2 to 10%. Exemplary compositions of such a ferrite powder are shown in Table 6 together with the characteristics thereof. The shrinkage ratio is restricted in order to match, to a maximum possible extent, the shrinkage ratio of the magnetic greensheets and that of the Ag conductive patterns and bump, which shrink from sintering only slightly. By matching the shrinkage ratios, the internal strain in the sintered magnetic body is reduced.

As the pre-sintering temperature of the powder increases, the shrinkage ratio is reduced but the magnetic characteristic of the powder is deteriorated. It is important that an additive for restricting such deterioration should be used. The inventors of the present invention have found that it is effective to add an organolead compound such as lead octylate in a small amount (0.1 to 1.0% with respect to ferrite) in order to restrict the deterioration of the magnetic characteristics while maintaining the shrinkage ratio low. One probable reason that such a compound is effective is: since an organolead compound is well dispersed in the ferrite slurry, Pb metal or PbO at an atomic level obtained by thermal decomposition of the organolead composition is dissolved into the grain boundary in the sintered magnetic body, thus to improve the sintering efficiency. By contrast, a PbO powder has a high specific gravity and thus easily separates from the ferrite in the slurry; namely, is poorly dispersed. Further, the PbO powder has inferior reactivity with the ferrite powder to Pb metal or PbO resulting from the thermal decomposition of the organolead compound. Accordingly, an oxide powder such as PbO is not effective as the additive.

Instead of the powder which is pre-sintered at a high temperature, non-shrinkage ferrite is also effective to reduce the shrinkage ratio. In this case, a Ni.Zn.Cu type ferrite powder, the amount of $Fe_2O_3$ of which is reduced, is pre-sintered, and then mixed with a mixture containing an Fe powder and unreacted NiO, ZnO and CuO. The compositions of the ferrite powder and the mixture, and also the mixture ratio are adjusted so that the expansion ratio of the Fe powder caused by oxidation into $Fe_2O_3$ and the shrinkage ratio of the ferrite powder as a result of the sintering will be equal to each other, as is shown in Table 5. Thus, the shrinkage ratio is reduced.

TABLE 5

| Ni.Zn.Cu type ferrite powder ($Fe_2O_3$:NiO:ZnO:CuO = 49:19:19:13 [molar ratio] Presintering temperature: 800° C.) [molar ratio]) | Mixture of Fe powder and metal oxide (Fe powder:NiO:ZnO:CuO = 49:19:19:13 |
|---|---|
| 40 wt % | 60 wt % |

The characteristics of the non-shrinkage ferrite are also shown in Table 6. The data in Table 6 are obtained under the conditions of the temperature of 910° C. and the sintering time of one hour.

COMPARATIVE EXAMPLE

Figure 14:
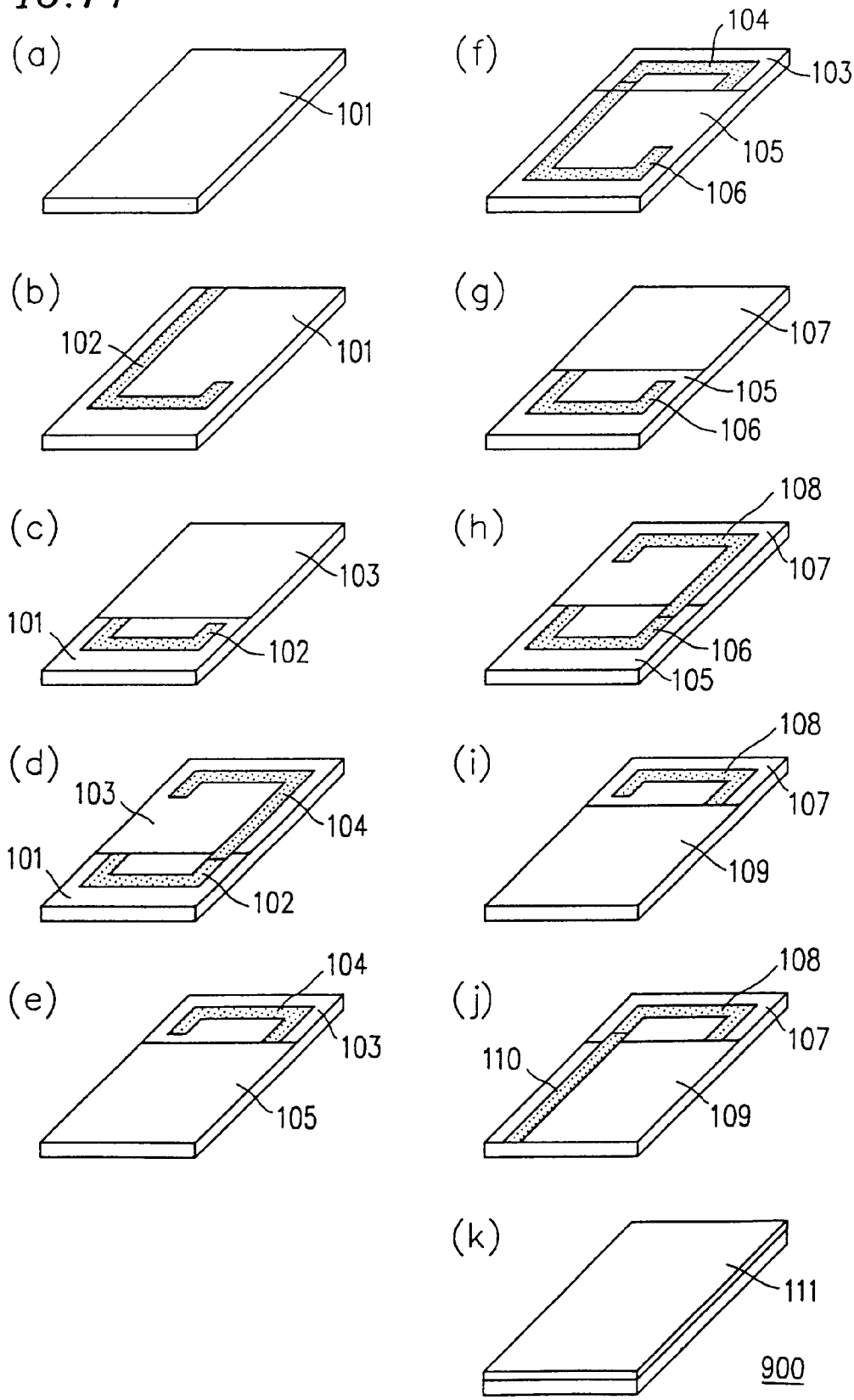
FIG. 14 is a schematic illustration of a method for producing a lamination ceramic chip inductor in a comparative example.

A lamination ceramic chip inductor 900 in a comparative example will be described. FIG. 14 is a schematic illustration of a method for producing the inductor 900.

As is shown in (a), a ferrite paste is printed in a rectangle to form an insulation sheet 101. Next, as is shown in (b), an Ag conductive paste of approximately half turn is printed on the sheet 101 to form a thick film conducive pattern 102. As is shown in (c), a ferrite paste is printed on the insulation sheet 101 so as to expose an end part of the conductive pattern 102, thereby forming an insulation sheet 103. As is shown in (d), an Ag conductive paste of approximately half turn is printed on the sheet 103 to be connected to the conductive pattern 102, thereby forming a thick film conductive pattern 104.

As is shown in (e) through (k), insulation sheets 105, 107, 109 and 111 and thick film conductive patterns 106, 108 and 110 are printed alternatively in the same manner. The resultant lamination body is sintered at a high temperature to produce the inductor 900 including a conductive coil having approximately 2.5 turns.

By this method, each conductive pattern has a width of approximately 150 $\mu$m and a thickness after being dried of approximately 12 $\mu$m is formed on an area of approximately 1.6 mm×0.8 mm.

Because the conductive coil has approximately 2.5 turns, the impedance of the inductor 900 is approximately 150 Ω at a frequency of 100 MHz. The DC resistance is approximately 0.16 Ω because the thickness of the conductive coil after being sintered is approximately 8 $\mu$m.

The conductive coil in the conventional inductor 900 has only 2.5 turns despite that the inductor 900 includes eleven layers. The impedance is excessively small in consideration of the number of the layers, and DC resistance is large for the impedance.

Further, the production method is complicated, and the connection between the conductive patterns is not sufficiently reliable.

Although the DC resistance can be reduced by forming the thick film conductive patterns using strikeplating as in the present invention, effects such as reduction in the number of the layers and increase in impedance are not achieved.

As has been described so far, according to the present invention, a conductor coil of the inductor is formed by

TABLE 6

| | Composition ratio (mol %) | | | | Presintering temp. | Average diameter | Amount of organolead compound | Shrinkage ratio | Impedance (Ω) |
|---|---|---|---|---|---|---|---|---|---|
| No. | $Fe_2O_3$ | NiO | ZnO | CuO | (° C.) | ($\mu$m) | (wt % to $Fe_2O_3$) | (%) | at 100 MHz |
| 1 | 49 | 19 | 19 | 13 | 800 | 1.2 | — | 9.2 | 620 |
| 2 | 49 | 19 | 19 | 13 | 900 | 1.9 | — | 6.4 | 405 |
| 3 | 49 | 19 | 19 | 13 | 900 | 1.9 | 0.2 | 6.7 | 548 |
| 4 | 49 | 19 | 19 | 13 | 900 | 1.9 | 0.4 | 6.8 | 595 |
| 5 | 49 | 19 | 19 | 13 | 900 | 1.9 | 1.0 | 7.0 | 585 |
| 6 | 49 | 19 | 19 | 13 | 1000 | 2.2 | — | 3.8 | 375 |
| 7 | 49 | 19 | 19 | 13 | 1000 | 2.2 | 0.2 | 3.9 | 503 |
| 8 | 49 | 19 | 19 | 13 | 1000 | 2.2 | 0.5 | 4.3 | 542 |
| 9 | 49 | 19 | 19 | 13 | 1100 | 2.7 | — | 2.2 | 321 |
| 10 | 49 | 19 | 19 | 13 | 1100 | 2.7 | 0.5 | 2.7 | 397 |
| 11 | 48.5 | 22.5 | 22.5 | 6.5 | 1100 | 2.4 | — | 3.8 | 390 |
| 12 | 48.5 | 22.5 | 22.5 | 6.5 | 1100 | 2.4 | 0.5 | 3.9 | 496 |
| 13 | Non-shrinkoge type ferrite (Table 5) | | | | | 1.9 | — | 0.1 | 570 |
| 14 | Non-shrinkage type ferrite (Table 5) | | | | | 1.9 | 0.2 | 0.4 | 618 |

electroforming. Since the photoresist, which is used in electroforming, has relatively high resolution, the width of the conductive patterns can be adjusted with high precision, for example, to the extent of several microns. The width of the conductive patterns can be adjusted in accordance with the resolution of the photoresist. Accordingly, a conductive coil having a larger number of turns can be formed in a smaller area than a conductor formed by printing.

Due to such a larger number of turns, a higher impedance is obtained despite the smaller number of layers.

The thickness of the conductive patterns can be controlled to be in the range from submicrons to several tens of microns by using an appropriate photoresist or appropriate plating conditions. The thickness of the conductive patterns can be even several millimeters by using appropriate conditions. Accordingly, the DC resistance can be easily controlled and thus can be reduced by increasing the thickness of the conductive patterns despite the fine patterns thereof.

Moreover, magnetic or insulation films having a high density can be obtained even before sintering by electroforming in contrast to formation of a coil pattern only by thick film conductive patterns. Thus, reduction of the thickness of the conductive patterns after sintering is insignificant, and the magnetic sheets and the conductive patterns are scarcely delaminated from each other.

The precise pattern and the high density of the conductor improve the reliability of the resultant inductor.

In the case where a low-ratio shrinkage powder or a non-shrinkage powder is used for the magnetic sheets, the shrinkage ratio by sintering is reduced. Thus, the sintered magnetic body having a higher and more uniform density is obtained.

According to the present invention, an inductor and a method for producing the same for providing a higher impedance at a lower resistance with a smaller number of layers are obtained.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A method for producing a lamination ceramic chip inductor, comprising the steps of:

forming a first conductive pattern on a first conductive base plate by electroforming;

transferring the first electroformed conductive pattern directly onto a first insulation layer;

forming a second conductive pattern on a second conductive base plate by electroforming;

transferring the second electroformed conductive pattern directly onto a second insulation layer;

forming a plurality of said first and second insulation layers each respectively having first and second electroformed conductive patterns transferred thereon; and sequentially laminating the plurality of first insulation layers to the plurality of second insulation layers while electrically connecting the first and second electroformed conductive patterns to each other.

2. A method for producing a lamination ceramic chip inductor according to claim 1, further comprising the step of interposing a third insulation layer having a through-hole therein between the first and the second insulation layers.

3. A method for producing a lamination ceramic chip inductor according to claim 1, wherein the first and second conductive patterns are electrically connected to each other by means of a through-hole filled with a thick film conductor printed therein formed in each of the plurality of second insulating layers, and the method further comprises the step of forming a plurality of third insulation layers on surfaces of the plurality of second insulation layers, the surfaces having the second electroformed conductive pattern.

4. A method for producing a lamination ceramic chip inductor according to claim 1, wherein the first and second conductive patterns are electrically connected to each other by means of a through-hole having a conductive bump formed as a result of electroforming in each of the plurality of second insulating layers, and the method further comprises the step of forming a plurality of third insulation layers on surfaces of the plurality of second insulation layers, the surfaces having the second electroformed conductive pattern.

5. A method for producing a lamination ceramic chip inductor according to claim 1, wherein the first and second electroformed conductive patterns are formed using an Ag electroplating bath having a pH value of 8.5 or less.

6. A method for producing a lamination ceramic chip inductor according to claim 1, wherein the first and second conductive base plates have a surface roughness of 0.05 to 1 $\mu$m.

7. A method for producing a lamination ceramic chip inductor according to claim 2, wherein the first, second and third insulation layers are magnetic.

* * * * *